United States Patent [19]

Goto

[11] Patent Number: 4,916,458

[45] Date of Patent: Apr. 10, 1990

[54] SLOTTED WAVEGUIDE ANTENNA

[75] Inventor: Naohisa Goto, Kawasaki, Japan

[73] Assignee: Asahi Kasei Kogyo Kabushiki Kaisha, Japan

[21] Appl. No.: 310,433

[22] Filed: Feb. 15, 1989

[30] Foreign Application Priority Data

Feb. 19, 1988 [JP] Japan ..... 63-37203

[51] Int. Cl.[4] ..... H01Q 13/10

[52] U.S. Cl. ..... 343/771; 343/770

[58] Field of Search ..... 343/771, 767, 768, 770

[56] References Cited

U.S. PATENT DOCUMENTS 3,419,870 12/1968 Wong ..... 343/771

3,696,433 10/1972 Killion et al. ..... 343/771

4,032,917 6/1977 Chin et al. ..... 343/771

*Primary Examiner*—Rolf Hille

*Assistant Examiner*—Doris J. Johnson

*Attorney, Agent, or Firm*—Finnegan, Henderson, Farabow, Garrett & Dunner

[57] ABSTRACT

A slotted waveguide antenna comprises a plurality of radiating waveguide having at least one radiating slot, a feed waveguide for feeding to the radiating waveguides, and coupling apertures arranged between the feed waveguide and the radiating waveguide at a distance of an integral multiple of the guide wavelength of the feed waveguide. The plurality of radiating waveguides are disposed in parallel to form an array in a manner that the radiating slots in the respective radiating waveguides are directed in the same direction. The feed waveguide is in the same plane as the array formed by the radiating waveguides. The transverse width of each radiating waveguide is one half of the distance between the adjacent coupling apertures. The coupling apertures provided on the feed waveguide supply electromagnetic waves having the same amplitude and the same phase to each radiating waveguide. The feed waveguide and the radiating waveguides are arranged integrally in the same plane so that the overall structure is planar. The structure of the antenna is simple, so that the antenna is manufactured easily and inexpensively.

9 Claims, 6 Drawing Sheets

FIG. 7A
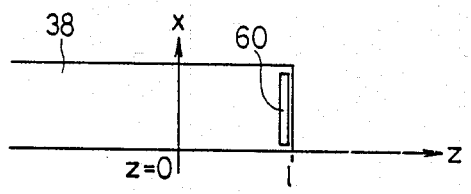
FIG. 7B
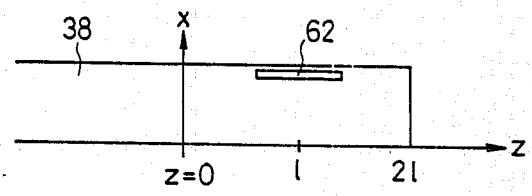
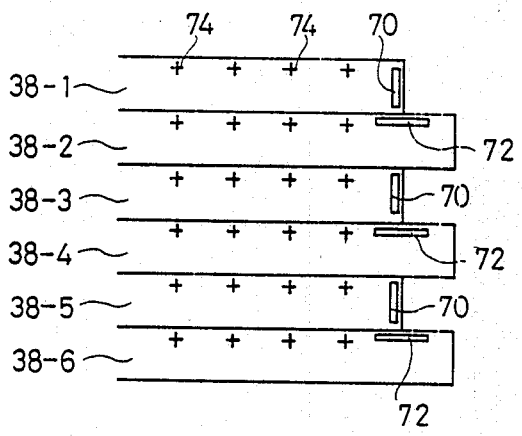
FIG. 8

SLOTTED WAVEGUIDE ANTENNA

BACKGROUND OF THE INVENTION

1. Field of the Invention

The present invention relates to a slotted waveguide antenna and more particularly to a slotted waveguide antenna which is suitable for communications with a communication satellite or a broadcasting satellite.

2. Description of the Prior Art

Parabolic antennas have typically been used for transmitting signals to and receiving signals from a communication satellite or a broadcasting satellite. Recently, however, attention has been directed to planar antennas, since planar antennas are more resistive to wind and snow and are easily installed.

Various antenna plane structures for planar antennas have been proposed in association with linearly polarized waves or circularly polarized waves. Planar antennas typically employ a microstrip or a triplate waveguide having a three conductive layer structure for the feed system. One typically known planar antenna has a waveguide array having a plurality of waveguides arranged in the transverse direction. The waveguide has a plurality of radiating slots arranged in the axial direction. As a result, the waveguide array as a whole has a plane antenna surface. One example of this type of planar antenna is disclosed in W. J. GETSINGER, "Elliptically Polarized Leaky-Wave Array", IRE TRANSACTIONS ON ANTENNAS AND PROPAGATION, pp165–172, March, 1962.

FIG. 1 is a perspective view showing an example of a conventional slotted waveguide antenna. Reference numerals 10, 12, 14, 16 and 18 denote radiating metal waveguides having a plurality of slots 20 for radiating electromagnetic waves on the upper planes thereof. Reference numeral 22 denotes a feed waveguide. The radiating waveguides 10, 12, 14, 16 and 18 are closely disposed in an array form in a manner that their radiating surfaces are on the upper side of the antenna. The feed waveguide 22 is secured to the lower side of the array composed of the waveguides 10, 12, 14, 16 and 18. The feed waveguide 22 has slots for electromagnetic wave coupling in portions where the feed waveguide 22 contacts the respective waveguides 10, 12, 14, 16 and 18.

When this conventional slotted waveguide antenna is manufactured, the respective waveguides 10, 12, 14, 16 and 18 are first made by combining metal plates with a proper precision suitable for a desired frequency, and then the waveguides are secured to each other in a transverse direction in an array-like manner. Subsequently, the feed waveguide 22 is secured to the lower side of the waveguide array. This manufacturing method is not suitable for mass production and thus a slotted waveguide antenna cannot be provided inexpensively using such method. Moreover, this antenna requires reinforcing members to avoid transformation or movement of the waveguides within the waveguide array. The antenna has a three-dimensional structure in which the feed waveguide 22 located on the bottom side of the radiating waveguides. Thus, this antenna loses an advantage of being planar and accordingly the manufacture of the antenna is not easy. The conventional slotted waveguide antenna is therefore not suitable for efficient and cost effective mass production.

SUMMARY OF THE INVENTION

It is an object of the present invention to provide a slotted waveguide antenna which is so structured to be manufactured easily and inexpensively.

According to the present invention, a slotted waveguide antenna is provided comprising:

- a plurality of radiating waveguides each having at least one radiating slot;
- a feed waveguide for feeding to the radiating waveguides; and
- a plurality of coupling apertures arranged between the feed waveguide and the radiating waveguides at a distance of an integral multiple of the guide wavelength of the feed waveguide;
- the plurality of radiating waveguides being disposed in parallel to form an array, each of at least one radiating slots being directed in the same direction;
- the feed waveguide being on the same plane as the array formed by the radiating waveguides; and
- each radiating waveguide having a transverse width equal to one half of the distance between adjacent coupling apertures.

Here, the feed waveguide may be directly connected to each of the plurality of radiating waveguides.

The slotted waveguide antenna may further comprise a plurality of conductive bar-like members arranged to form walls of the feed waveguide and the radiating waveguides.

Here, the radiating waveguides and the feed waveguide may be arranged integrally in the form of a dielectric sheet metalized both sides.

Further, plated through-holes may be arranged at a predetermined interval in the dielectric sheet at positions corresponding to a border between the feed waveguide and the radiating waveguide and at positions corresponding to a border between two adjacent radiating waveguides, so that the through-holes electrically connect both the metalized sides of the dielectric sheet to form waveguide walls.

The feed waveguide may have a main feed waveguide and a sub-feed waveguide coupled to the main feed waveguide. The main feed waveguide and the sub-feed waveguide are arranged on the same plane as the array of the radiating waveguides. The feed waveguide antenna may further comprise a plurality of main coupling apertures arranged at an interval equal to an integral multiple of a guide wavelength to the main feed waveguide in a wall defining boundaries between the main feed waveguide and the sub-feed waveguide, a transverse width of the radiating waveguide being one half of a distance between two adjacent main coupling apertures; and a plurality of sub-coupling apertures, each corresponding to each of the plurality of radiating waveguides and provided in a wall of the sub-feed waveguide which is opposite to the wall in which the plurality of main coupling apertures are provided.

The slotted waveguide antenna may further comprise a plurality of conductive bar-like members arranged to form walls of the feed waveguide and the radiating waveguides.

Here, the radiating waveguides and the feed waveguide may be arranged integrally in the form of a dielectric sheet metalized both sides.

Further, plated through-holes may be arranged at a predetermined interval in the dielectric sheet at positions corresponding to a border between the main feed waveguide and the sub-feed waveguide, at positions corresponding to a border between the sub-feed waveguide and the radiating waveguide and at positions corresponding to a border between two adjacent radiating waveguides, so that the through-holes electrically connect both the metalized sides of the dielectric sheet to form waveguide walls.

The coupling apertures provided on the feed waveguide supply electromagnetic waves having the same amplitude and the same phase to each radiating waveguide. The feed waveguide and the radiating waveguides can also be arranged integrally on the same plane so that the overall structure is planar. The structure of the antenna is simple, so that the antenna can be manufactured easily and inexpensively.

Because each partition wall may be formed by through-holes or conductive pins, the slotted waveguide antenna is manufactured very easily and is suitable for inexpensive mass production. Because a printing technique is utilized to fabricate this antenna, it is further expected to improve manufacturing precision.

The above and other objects, effects, features and advantages of the present invention will become more apparent from the following description of preferred embodiments thereof taken in conjunction with the accompanying drawings.

BRIEF DESCRIPTION OF THE DRAWINGS

FIGS. 7A and 7B are explanatory diagrams showing the terminal structure of the radiating waveguide 38 for the antenna shown in FIG. 2A;

FIG. 8 is a partial schematic diagram showing an embodiment employing the terminal structure shown in FIGS. 7A and 7B.

DETAILED DESCRIPTION OF PREFERRED EMBODIMENTS

Hereinafter, embodiments of the present invention will be described with reference to the drawings. In the following description, the present invention will be explained for the case of a transmitting antenna, but the present invention can be, of course, used as a receiving antenna according to the reciprocity theorem.

Figure 1:
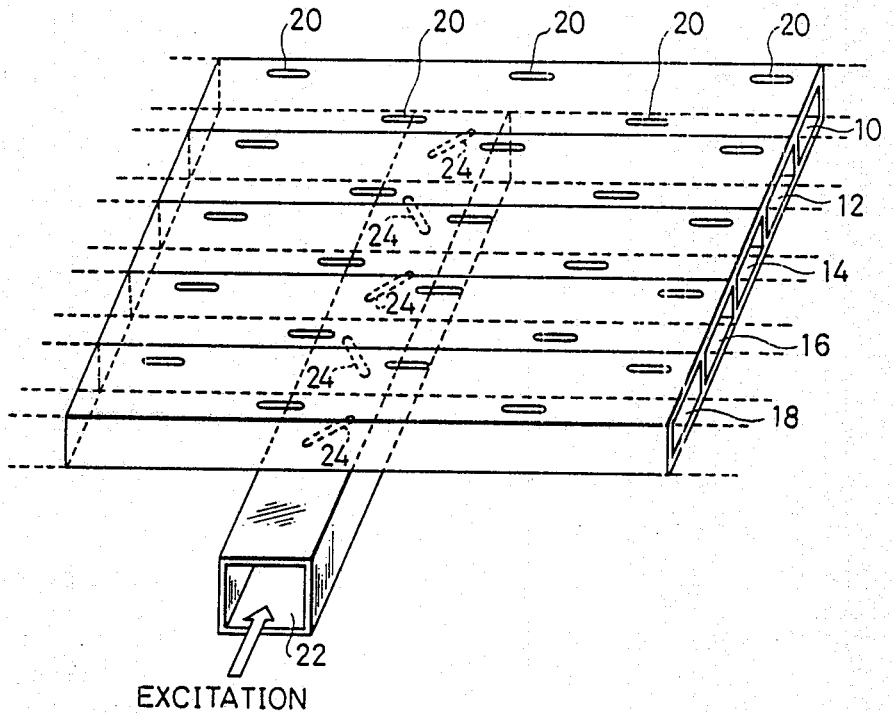
FIG. 1 PRIOR ART
FIG. 1 is a perspective view showing an example of a conventional slotted waveguide antenna having a three-dimensional feed structure.
Figure 2A:
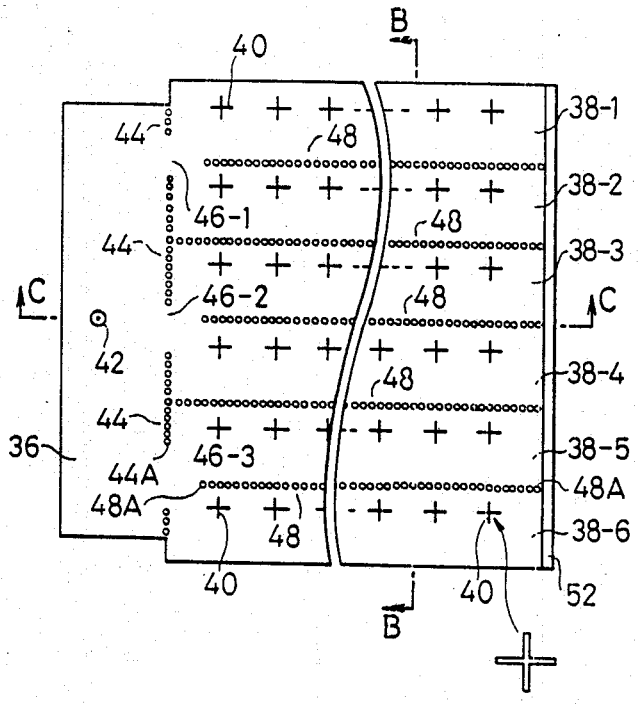
FIG. 2A is a plan view showing one embodiment of a slotted waveguide antenna incorporating the teachings of the present invention.
Figure 2B:
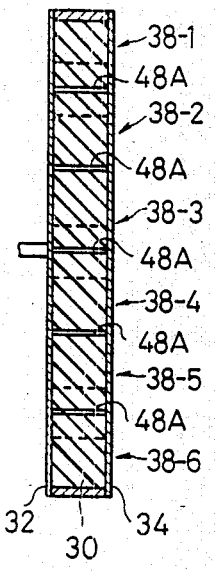
FIG. 2B is a sectional view of the antenna taken along line B—B in FIG. 2A.
Figure 2C:
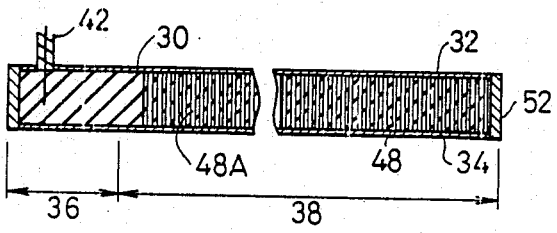
FIG. 2C is a sectional view of the antenna taken along line C—C in FIG. 2A.
Figure 3:
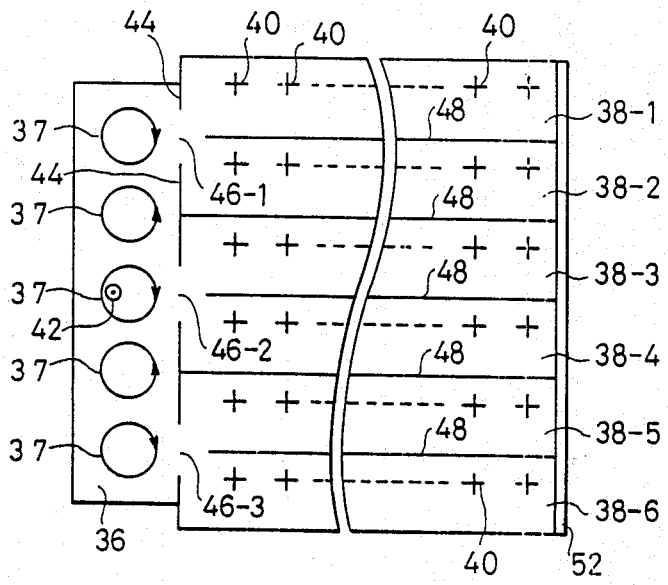
FIG. 3 is a schematic diagram showing the waveguide mechanism of the embodiment shown in FIG. 2A.

FIG. 2A is a plan view showing one embodiment of a slotted waveguide antenna in accordance with the present invention. FIG. 2B is a sectional view of the antenna taken along line B—B of FIG. 2A. FIG. 2C is a sectional view of the antenna taken along line C—C of FIG. 2A. FIG. 3 shows the waveguide structure of the embodiment.

This embodiment has a dielectric sheet metallized both sides and basically having a dielectric sheet or plate 30 with a predetermined thickness and conductive metal layers 32 and 34 which are respectively disposed on both sides, i.e., on the upper and the bottom surfaces of the dielectric sheet or plate 30 by metalizing both the sides thereof. A plate having a metal film affixed to one side thereof may be used in place of the conductive metal layers 32 and 34.

This dielectric sheet metalized on both sides further includes waveguide walls formed by walls 44 and 48 to be described later, in each waveguide section. The walls 44 and 48 serve to define a feed waveguide 36 and a plurality (six, in this embodiment) of radiating waveguides 38 (38-1, 38-2, . . . , 38-6). Each radiating waveguide 38 provides a plurality of radiating slots, for example, crossed slots 40. The radiating slots 40 are periodically arranged at an interval of one guide wavelength $\lambda_g$ of the radiating waveguide 38, for instance, or an integral multiple thereof. Reference numeral 42 denotes a coaxial cable, one end of which is connected to the feed waveguide 36 and the other end of which is connected to a signal source (not shown).

The wall 44 of the feed waveguide 36 on the side of the radiating waveguides 38 has coupling apertures 46 (46-1, 46-2, 46-3) arranged at an interval of one guide wavelength $\lambda_g$ of the feed waveguide 36. The transverse width d of each radiating waveguide 38-n (n=1 through 6) is equal to one half of the guide wavelength $\lambda_g$ of the feed waveguide 36. The detailed reason will be described later. Two radiating waveguides 38 are assigned to each coupling aperture 46. That is, viewing the radiating waveguide 38 through each coupling aperture 46, two radiating waveguides 38 are symmetric to each other with respect to the center of the two radiating waveguides 38, i.e. with respect to the corresponding wall 48.

According to waveguide theory, it is known that it is not necessary to close the waveguide wall completely and a slight gap is allowed, though the width of the gap depends on the guide wavelength. As viewed from FIG. 2A, a plurality of conductive through-holes 44A and 48A passing through the dielectric sheet to short-circuit the conductive metal layers 32 and 34 form the wall 44 of the feed waveguide 36 on the side of the radiating waveguide 38 and the wall 48 defining the radiating waveguides 38-n, respectively. These conductive through-holes 44A and 48A are made by plating, for example. The plated through-holes make it possible to employ printed circuit board manufacturing techniques and to achieve manufacturing accuracy required for the waveguide. The plated throughholes therefore offer excellent capability for mass production.

The walls 44 and 48 can alternatively be formed by planting conductive bar-like members, for example, conductive pins into the dielectric sheet metalized on both sides in place of the through-holes 44A and 48A. Of course, both the through-holes and the conductive pins may be used in combination.

The radiating waveguide 38 has at its terminal end a member for preventing electromagnetic wave reflection such as a non-reflecting absorber 52. Alternatively, a known matching slot or a reduced reflection structure to be described later may be used. In the outer peripheral portion of the waveguide shown in FIG. 2A, waveguide walls required for the waveguides 36 and 38 are formed. The waveguide walls can be fabricated by plated through-holes, conductive pins, conductive films or conductive plates.

When the antenna shown in FIG. 2A is manufactured, the dielectric plate 30 of a predetermined thickness is sandwiched between the conductive layers 32 and 34 and then the through-holes 44A and 48A are opened or formed at a predetermined interval, or the conductive pins are planted at a predetermined interval, to define the waveguide walls of the feed waveguide 36 and the radiating waveguide 38. In the portion where the walls of the waveguides 36 and 38 coincides with the outer peripheral surface of the waveguide, the surface can be covered with a conductive material to form the waveguide wall.

Figure 4:
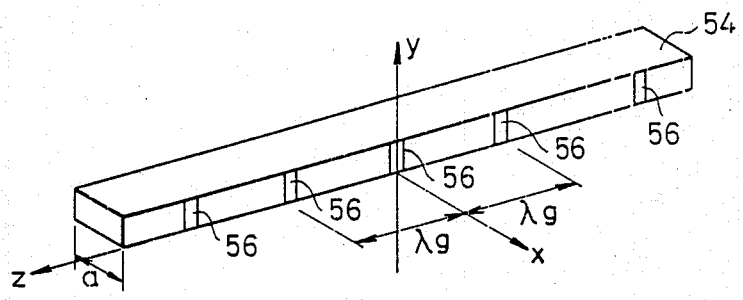
FIG. 4 is a schematic view showing the coordinate relation of the coupling aperture provided on the waveguide shown in FIG. 2A.

Next, the theoretical background will be described in association with the position of the feed waveguide 36 and, in particular, the coupling aperture 46. If an opening or slot formed on the side wall of the waveguide is larger than a given size, the opening or slot may cause leakage of the electromagnetic waves. The inventors of the subject invention have analyzed this behavior, when slots 56 are periodically provided on the side wall of a waveguide 54 at an interval of one guide wavelength $\lambda_g$ of the waveguide 54, as shown in FIG. 4. The electromagnetic wave leaked from the slots 56 periodically changes its amplitude and phase in the longitudinal direction of the waveguide 54.

Figure 5A:
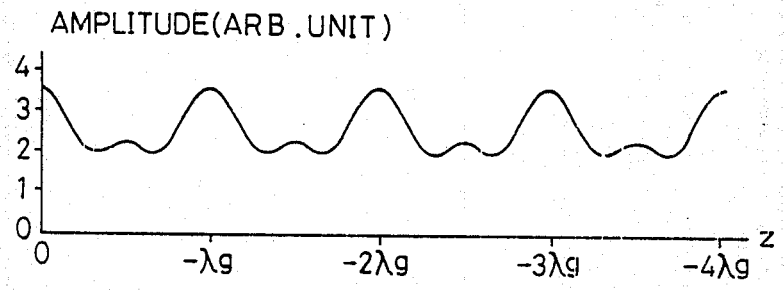
FIGS. 5A and 5B are graphs showing amplitude and phase characteristics for the slots 56 shown in FIG. 4.
Figure 5B:
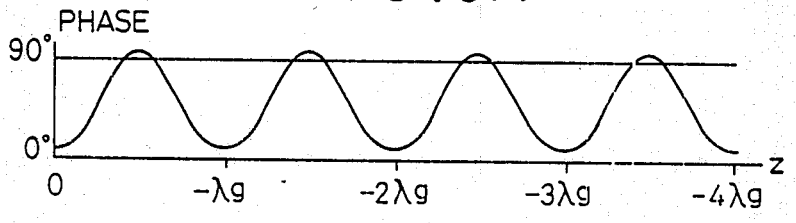

FIGS. 5A and 5B show the amplitude and phase characteristics at the position having a distance of $\lambda/2$ from the slot 56 in the case of a 12 GHz waveguide (free space wavelength: $\lambda=25$ mm, waveguide width: $a=19$ mm, guide wavelength $\lambda g=33$ mm).

As will be clear from FIG. 4, FIG. 5A and FIG. 5B, an electromagnetic wave having an equal amplitude and an equal phase is derived from each of the coupling apertures 46-1, 46-2, 46-3 shown in FIG. 3. The electromagnetic wave is supplied to the corresponding waveguide 38-n ($n=1, \ldots, 6$). In FIG. 3, reference numeral 37 denotes a line of magnetic force. Accordingly, each radiating waveguide 38-1, . . . , 38-6 is excited in the same manner. As a result, a desired electromagnetic waves such as linearly polarized waves or circularly polarized waves are radiated from the radiating slot 40 of each radiating waveguide in accordance with the shape of the slot and the arrangement of the slots. The above-mentioned article by Getsinger discusses the arrangement per se of crossed slots in the slotted waveguide antenna for radiating circularly polarized waves from a plurality of crossed slots.

Figure 6:
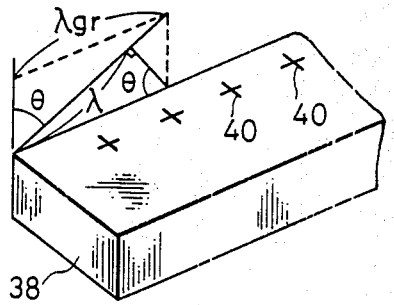
FIG. 6 is an explanatory diagram showing the radiating direction of the waveguide 38 for the antenna shown in FIG. 2A.

FIG. 6 is a perspective view showing one radiating waveguide 38. In the waveguide 38, the guide wavelength $\lambda_{gr}$ is larger than the free space wavelength $\lambda$. Assuming that $\theta$ is a radiating angle or tilt angle with respect to a plane perpendicular to the radiation surface formed by the radiating slots 40, as shown in FIG. 6, $\theta$ is given by $$\sin\theta=\lambda/\lambda_{gr}.$$

Therefore, in this embodiment, the electromagnetic wave is radiated not in the vertical direction but the inclined direction with respect to the radiation surface (antenna surface). Assuming that the transverse width of the radiating waveguide 38 is d, the guide wavelength $\lambda_{gr}$ is given by $$\lambda_{gr}=\frac{\lambda}{[1-(\lambda/2d)^2]^{\frac{1}{2}}}.$$

As described above, d is designed as follows: $d=\lambda_g/2$ in association with the guide wavelength $\lambda_g$ of the feed waveguide 36.

For example, assuming that $d=16.5$ mm is given for $\lambda=25$ mm (12 GHz), $\lambda_{gr}=38.3$ mm and the radiating angle $\theta=40.7°$ are obtained.

Next, the terminal structure of the radiating waveguide 38 will be explained. It is preferable that the terminal is a matching slot, as described above, but it is not easy to realize such a matching slot. Accordingly, the matching slot results generally in an expensive antenna. Further, the provision of the non-reflecting absorber is not an effective design approach, because a material which can absorb electromagnetic waves sufficiently to negate the reflection of the electromagnetic waves is very expensive, even if such material were available on the market, and also because the provision of the non-reflecting absorber complicates the manufacturing process of the antenna.

The present invention, therefore, has the following structure. That is, in the case of a circularly polarized wave, linear radiating slots are provided in such a manner that a specific phase relation, which defines desired polarization surfaces, is formed between adjacent radiating waveguides, and the end portion of the radiating waveguide is a short-circuited wall formed by through-holes or conductive pins such as those forming the waveguide walls. In the case of a linearly polarized wave, a terminal wall is provided for each radiating waveguide and it is sufficient that the terminal wall is short-circuited in the same manner.

The structure for the case of the circularly polarized wave will now be described with reference to FIGS. 7A and 7B. Assuming that the Z-axis is defined as the longitudinal direction of the radiating waveguide 38, and that the X-axis is defined as the transverse direction thereof, as shown in FIGS. 7A and 7B, an origin is set at a suitable point on the Z-axis. The waveguide is short-circuited at the position having a distance l from the origin and a slot 60 extending in the X-axis direction is provided immediately before the position at which the waveguide is short-circuit, as shown in FIG. 7A. Considering the case where a wave propagating only in +Z direction exists, the TE mode propagating through the waveguide 38 is given by:

$$E_y=A\exp(-j\beta z) \quad (1)$$

$$H_x=-B\exp(-j\beta z) \quad (2)$$

$$H_z=jC\exp(-j\beta z) \quad (3)$$

Thus, $$H_z/H_x=-jD \quad (4)$$

is obtained, where A, B, C and D are real numbers. Assuming that the short-circuiting wall is disposed at $z=l$ from the origin ($z=0$), the following equations are obtained as a result of a reflected wave that is generated:

$$E_r=A\,[\exp(-j\,\beta_z)-\exp(j\beta(z-2l))]= \quad (5)$$

-continued $$-2jA \exp(-j\beta l) \sin \beta(z-l)$$

$$H_x = -B[\exp(-j\beta z) + \exp(jb(z-2l))] = \quad (6)$$

$$-2B \exp(-j\beta l) \cos \beta(z-l)$$

$$H_z = jC[\exp(-j\beta z) - \exp(j\beta(z-2l))] = \quad (7)$$

$$2C \exp(-j\beta l) \sin \beta(z-2l).$$

Thus, at the position of z=l, the following relationship is obtained:

$$H_x = -2B \exp(-j\beta l) \quad (8).$$

Further, as shown in FIG. 7B, assuming that short-circuiting wall is disposed at Z=2l from the origin (z=0) and the slot 62 extending along the Z-axis is provided at the position of z=l, the following relationship is obtained:

$$H_z = -2C \exp(-j2\beta l) \sin \beta(z-2l) \quad (9).$$

At the position of the slot 62, the following relationship is established:

$$H_z = 2C \exp(-j2\beta l) \text{ sig } \beta l \quad (10).$$

The ratio between $H_x$ of equation (8) and $H_z$ of equation (10) is determined as follows:

$$H_z/H_x = -jD[j \exp(-j\beta l)] \sin \beta l. \quad (11)$$

Assuming that $\beta l = \pi/2$ is given, then the following is obtained:

$$H_z/H_x = -jD.$$

This equation indicates a circularly polarized wave.

Accordingly, if the radiating waveguides 38-1, . . . 38-6 disposed in parallel in the form of an array alternately have terminal structures having the slot arrangement and the short-circuiting surface shown in FIGS. 7A and 7B, respectively, the electromagnetic waves propagating through each radiating waveguide 38 can be substantially radiated to the outside of the waveguide 38, so that the efficiency of electromagnetic wave radiation is improved.

FIG. 8 is a plan view showing a terminal in which the above-described structure is employed. In FIG. 8, reference numeral 70 denotes a slot corresponding to the slot 60 shown in FIG. 7A and reference numeral 72 denotes a slot corresponding to the slot 62 shown in FIG. 7B. Reference numeral 74 denotes a known crossed slot for circularly polarized waves.

Figure 9:
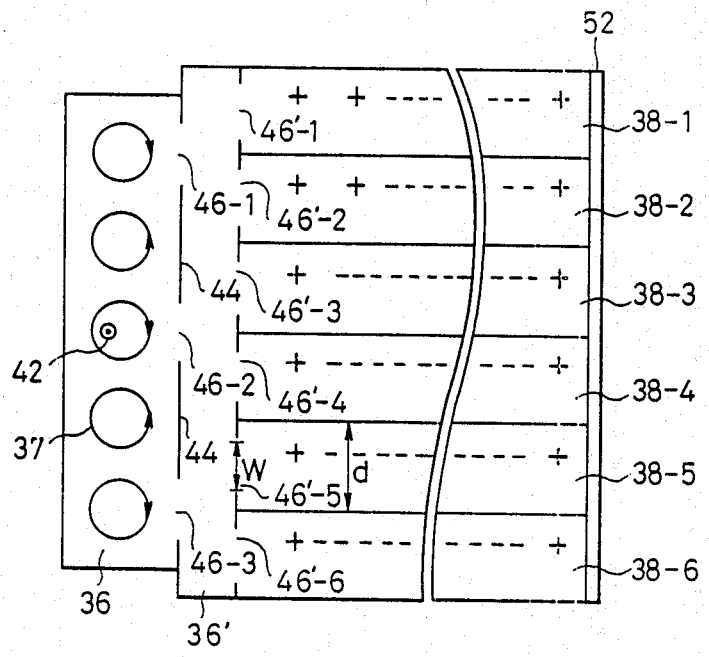
FIG. 9 is a schematic diagram showing the waveguide mechanism of a modified embodiment.

In the embodiment shown in FIGS. 2A, 2B, 2C and 3, the radiating waveguide 38 has the side walls 48 which are not opposite to the coupling aperture 46 and the side walls 48 are coupled to the wall 44 of the feed waveguide 36 in a manner that each coupling aperture 46 of the feed waveguide 36 feeds only to the two radiating waveguides 38 corresponding to the coupling aperture 46. But, the present invention is not limited to this embodiment. For example, as shown in FIG. 9, the radiating waveguide 38 may have an input port positioned at a predetermined distance from the coupling aperture 46. In FIG. 9, reference numeral 36' denotes a sub-feed waveguide and 46' (46'-1, . . . , 46'-6) denotes a direct coupling aperture for each radiating waveguide 38. The electromagnetic wave leaked from the coupling aperture 46 has a periodicity as shown in FIGS. 5A and 5B and the structure of the radiating waveguide 38 also has a regularity matched to the periodicity, so that little interference occurs due to the electromagnetic waves leaked from the other aperture 46, even if such interference exists at all.

Further, it is preferable that the radiating waveguide 38 is a waveguide in which electromagnetic waves propagate only in a single waveguide mode. For cases in which the radiating waveguide 38 has higher modes, it is preferable that the width W of the coupling aperture 46 of the radiating waveguide 38 on the feed side is narrower than the width d of the waveguide 38 in order to improve a coupling efficiency of the waveguide 36' to the waveguide 38.

Further, since the direct coupling aperture 46' for the radiating waveguide 38 is symmetrical with respect to the center of the radiating waveguide 38, it is expected that an excitation efficiency in a single waveguide mode becomes high, even if there exists only a single waveguide mode in the radiating waveguide 38. A high excitation efficiency means a large radiating loss. Consequently, the Q value is reduced. Thus, it is expected that the frequency characteristic has a wide band characteristic.

As will be appreciated from the foregoing description, the present invention provides a planar antenna which can be manufactured easily and, accordingly, which is inexpensive.

While in the embodiments described above, the waveguides are in the form of dielectric sheet metalized both sides, it is to be noted that the waveguides to be used in the present invention is not limited to the threelayer waveguide having the dielectric sheet metalized both sides. For example, a conventional waveguide, i.e., a hollow waveguide can be used.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A slotted waveguide antenna comprising:

a plurality of radiating waveguides each having at least one radiating slot;

a feed waveguide for feeding to said radiating waveguides; and a plurality of coupling apertures arranged between said feed waveguide and said radiating waveguides at a distance of an integral multiple of a guide wavelength of said feed waveguide;

said plurality of radiating waveguides being disposed in parallel to form an array, each of at least one radiating slots being directed in the same direction;

said feed waveguide lying in the same plane as the array formed by said radiating waveguides; and each radiating waveguide having a transverse width equal to one half of the distance between the adjacent coupling apertures, whereby each two of said plurality of radiating waveguides are excited by one of said plurality of coupling apertures.

2. The slotted waveguide antenna as claimed in claim 1, wherein said feed waveguide is directly connected to each of said plurality of radiating waveguides.

3. The slotted waveguide antenna as claimed in claim 2, further comprising a plurality of conductive bar-like members arranged to form walls of said feed waveguide and said radiating waveguides.

4. The slotted waveguide antenna as claimed in claim 2, wherein said radiating waveguides and said feed waveguide are arranged integrally in the form of a dielectric sheet metalized both sides.

5. The slotted waveguide antenna as claimed in claim 4, wherein plated through-holes are arranged at a predetermined interval in said dielectric sheet at positions corresponding to a border between said feed waveguide and said radiating waveguide and at positions corresponding to a border between two adjacent radiating waveguides, said through-holes electrically connecting both the metalized sides of said dielectric sheet to form waveguide walls.

6. The slotted waveguide antenna as claimed in claim 1, wherein said feed waveguide has a main feed waveguide and a sub-feed waveguide coupled to said main feed waveguide, and said main feed waveguide and said sub-feed waveguide lie in the same plane as one another and in the same plane as said array of said radiating waveguides; and further comprising:

a plurality of main coupling apertures arranged at an interval equal to an integral multiple of a guide wavelength of said main feed waveguide in a wall defining boundaries between said main feed waveguide and said sub-feed waveguide, a transverse width of said radiating waveguide being one half of a distance between two adjacent main coupling apertures; and a plurality of sub-coupling apertures, each corresponding to each of said plurality of radiating waveguides and provided in a wall of said sub-feed waveguide which is opposite to said wall in which said plurality of main coupling apertures are provided.

7. The slotted waveguide antenna as claimed in claim 6, further comprising a plurality of conductive bar-like members arranged to form walls of said feed waveguide and said radiating waveguides.

8. The slotted waveguide antenna as claimed in claim 6, wherein said radiating waveguides and said feed waveguide are arranged integrally in the form of a dielectric sheet metalized both sides.

9. The slotted waveguide antenna as claimed in claim 8, wherein plated through-holes are arranged at a predetermined interval in said dielectric sheet at positions corresponding to a border between said main feed waveguide and said sub-feed waveguide, at positions corresponding to a border between said sub-feed waveguide and said radiating waveguide and at positions corresponding to a border between two adjacent radiating waveguides, said through-holes connecting electrically both the metalized sides of said dielectric sheet to form waveguide walls.

* * * * *